United States Patent [19]

Jones et al.

[11] 4,105,116

[45] Aug. 8, 1978

[54] SAMPLE-CONTAINING ENVELOPE ASSEMBLY

[75] Inventors: John H. Jones, Westfield; James T. Hoffman, Readington, both of N.J.

[73] Assignee: Beatrice Foods Co., Chicago, Ill.

[21] Appl. No.: 737,006

[22] Filed: Oct. 29, 1976

[51] Int. Cl.[2] ..... B65D 75/00; B65D 75/62

[52] U.S. Cl. ..... 206/484; 206/459; 206/592; 206/611

[58] Field of Search ..... 206/461, 462, 463, 466, 206/477, 484, 521, 591, 592, 464, 465, 557, 563, 459; 229/66

[56] References Cited

U.S. PATENT DOCUMENTS

| | | | |
|---|---|---|---|
| 857,767 | 6/1907 | Stephens | 206/484 X |
| 2,333,587 | 11/1943 | Salfisberg | 206/484 X |
| 2,745,545 | 5/1965 | Dunning | 206/466 |
| 2,921,731 | 1/1960 | Volckening et al. | 206/484 X |
| 3,018,015 | 1/1962 | Agriss et al. | 206/591 X |
| 3,179,327 | 4/1965 | Burton et al. | 229/66 |
| 3,494,538 | 2/1970 | Matthews | 229/66 X |
| 3,540,583 | 11/1970 | Tomlinson | 206/466 X |
| 3,744,627 | 7/1973 | Rope et al. | 206/484 |
| 3,809,217 | 5/1974 | Harrison | 206/484X |

*Primary Examiner*—Stephen Marcus

*Attorney, Agent, or Firm*—Shlesinger, Arkwright, Garvey & Dinsmore

[57] ABSTRACT

A substantially flat but relatively thick sectioned sample protector is disposed within a closed and readily openable envelope. It has a sample holding pocket into which a fragile, relatively flat sample is disposed.

7 Claims, 5 Drawing Figures

SAMPLE-CONTAINING ENVELOPE ASSEMBLY

BACKGROUND OF INVENTION

The advertising industry has been using mass distribution of advertising circulars and printed material on a widespread basis to reach prospective customers.

One of the more effective methods of distributing such material has been use through the use of newspaper inserts or by mail. This technique has to date precluded the inclusion of material samples which are fragile or contain fluid products.

As a result, distribution of such samples has been limited to retail store outlets, or special packaging arrangements where mail is to be used, or individual distribution on a door-to-door basis.

This invention is directed to providing an answer to this particular situation, such that it is possible to use the distribution methods for printed advertising material to permit distribution of samples with the advertising, such samples being fragile or in liquid form. This is accomplished by the use of a new packaging technique which makes it possible to distribute such samples in the same manner as ordinary printed advertising circulars and material.

SUMMARY OF INVENTION

Accordingly, this invention relates to a new method of packaging fragile and liquid samples. It is particularly directed to a packaging arrangement in which such samples can economically be packaged and distributed by mass distribution techniques heretofore restricted to flat printed material.

A new type of container assembly is used which introduces a thickened type envelope assembly which is relatively flat and accommodates fragile or liquid samples such that the assembly can be used as an insert in a newspaper or as an ordinary mailing envelope for mass distribution purposes.

The envelope is of a special type which is readily openable, economical to produce, and lends itself to pre-printing and mass production techniques.

In addition, the assembly includes a relatively flat but thick sectioned sample protector which provides the necessary protection for the fragile or liquid containing sample.

DESCRIPTION OF THE INVENTION

Figure 1:
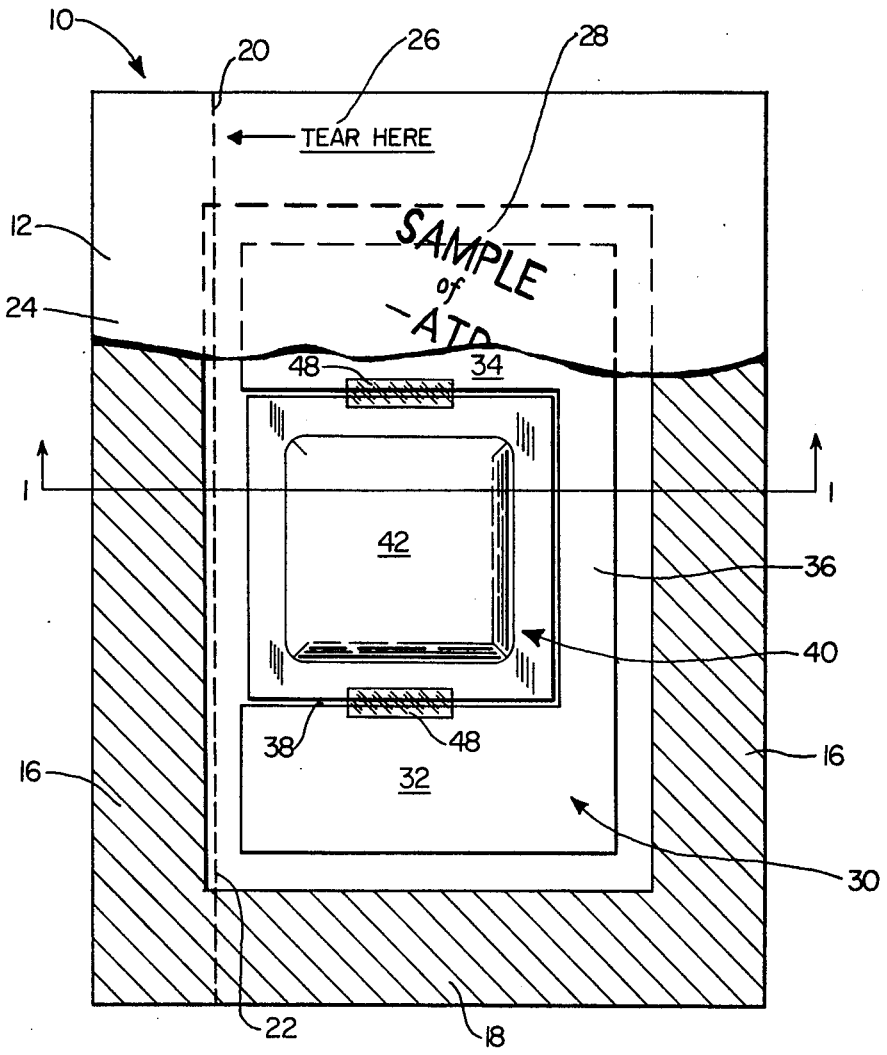
FIG. 1 is a plan view of the envelope assembly partially cut away to show the sample protector and the sample in position.
Figure 2:
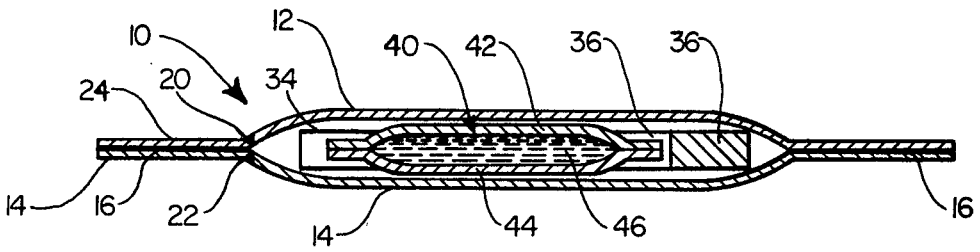
FIG. 2 is an enlarged sectional view of the envelope assembly of FIG. 1 as taken along line 1—1.

Referring particularly to FIG. 1 and to FIG. 2, the sample-containing envelope assembly is generally indicated at 10, and shows an outer pre-printed envelope having a top panel 12 and a bottom panel 14 which are glued together by side adhesive strips 16 and top and bottom adhesive strips 18 to form a closed envelope around the entire envelope periphery.

The top panel 12 has a line of perforations 20 and the bottom panel 14 has a line of perforations 22 which are disposed immediately adjacent each other and inside the side glue strips 16 to form the removable tear-off section 24. Printed instructions 26 are contained on the envelope panels.

It is contemplated that the envelope being a two-piece top and bottom assembly would be pre-printed before assembly with appropriate advertising as shown at 28.

A sample protector generally indicated at 30 is disposed within the envelope and has a general U-shaped configuration with end pieces 32 and 34 connected by bridging section 36 to form the periphery 38 of an interior sample-holding pocket. Note with respect to FIG. 2 that the cross-sectional dimension of the sample protector 30 is relatively thick. It is contemplated that thick relatively incompressible material, such as a thick cardboard could be used. With reference to FIG. 1, it will be noted that the open end of the pocket faces the tear-off side strip 24, and that there is ample clearance between the sample protector 30 and the glue strip sections around the periphery of the envelope.

The sample 40 is pliable and flexible and is, as can be seen in FIG. 2, about the same thickness as the thickness of the sample protector 30. In this instance, the sample 40 includes upper and lower sheets of plastic or foil, 42 and 44 respectively, which are sealed along their edges. A liquid or lotion to be sold, indicated at 46 is enclosed therein. The sample can be held in place, if desired, by adhesive strips 48.

Figure 3:
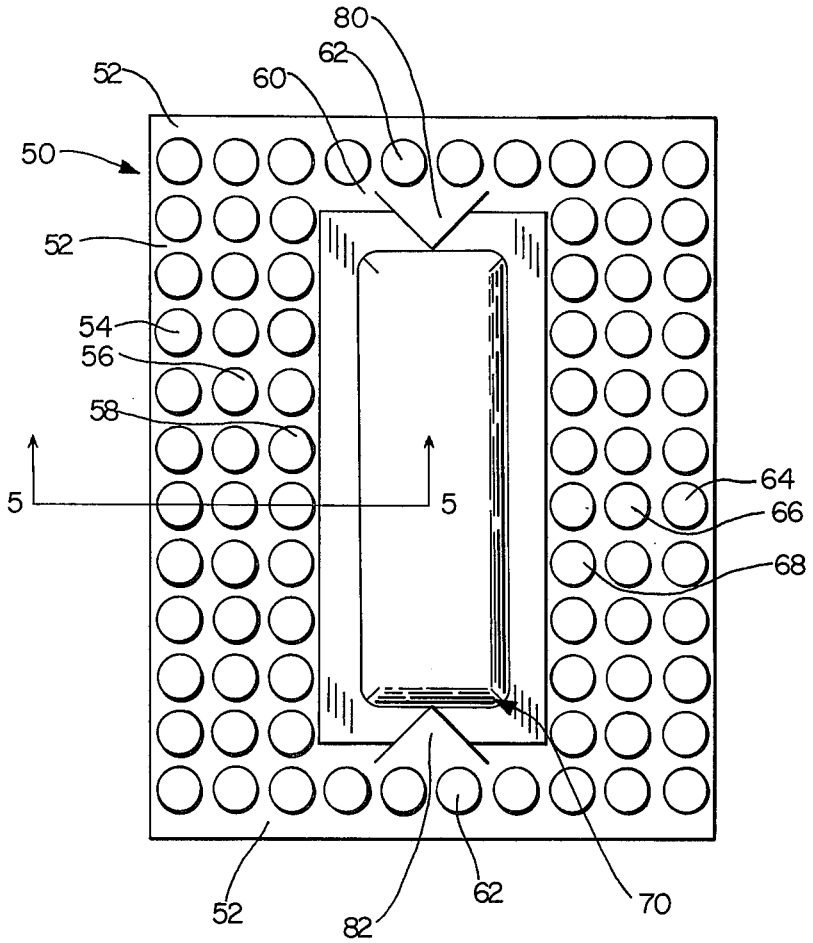
FIG. 3 is a plan view of a pliable plastic sample protector and sample.

Another sample protector which is usable with the envelope previously described is generally indicated at 50 in FIG. 3. This sample protector is made from a thin pliable sheet 52 of plastic material and has plural rows of upstanding spacer elements which give the desired thickness to the protector, while at the same time leaving it pliable and slightly bendable. However, the elements themselves impart rigidity in the cross-sectional direction to the pressure exerted against the top and bottom surfaces and will not permit collapsing or squeezing of the protector.

Figure 4:
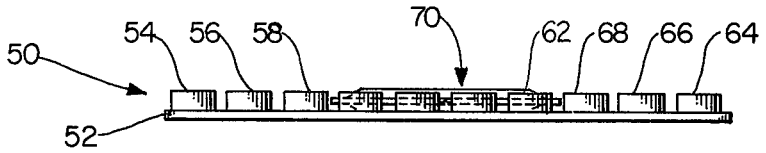
FIG. 4 is an end view of the sample holder and sample of FIG. 3.
Figure 5:
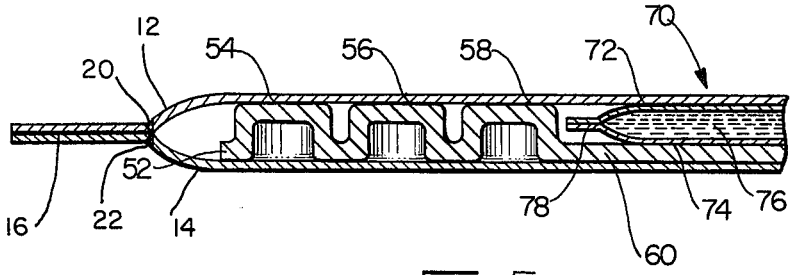
FIG. 5 is an enlarged view as taken along line 5—5 of FIG. 3.

Referring to FIGS. 3 to 5, the upstanding support elements are arranged in rows with three rows of upstanding elements 54, 56, and 58 on one side defining a border of a flat sample-containing section 60 of the pliable sheet. The other side of the flat sample-receiving section 60 is bounded by the three rows of upstanding elements 64, 66, and 68. The top and bottom periphery is determined by the two horizontal rows of four upstanding elements 62 located both above and below the flat sample-receiving area 60. The sample generally indicated at 70 and more particularly shown in FIG. 5 has upper and lower sheets of pliable material which are joined along their periphery as shown at 78 in FIG. 5.

The sample is held in position by cut-out portions 80 and 82 which are cut from the lower flat surface 60 and under which the ends of the sample 70 are placed.

The sample protector of FIG. 3, as well as that of FIG. 1, although open, provide protection for a sample which would be distributed through channels in which a great deal of flat crushing pressure would be applied.

Thus methods of distribution, such as ordinary mail, or newspaper insert delivery, which previously made such methods of distribution impossible because of the crushing pressure to which the sample would be subjected, are now possible.

The use of a relatively flat, preferably rectangular sample, the relatively flat sample protector, and the special envelope construction, make this possible.

In addition to the functional aspects, the ability to mass produce special pre-printed envelopes, which can be very economically produced, and also specially printed and constructed, lends itself to mass distribution give-away sample advertising.

The envelope which is constructed of two superposed panels glued together along a periphery with glue strips sufficiently wide to stand up during handling, as well as a readily openable feature, are additional features which lend themselves to the mass distribution advertising market.

While this invention has been described, it will be understood that it is capable of further modification, uses and/or adaptations of the invention following in general, the principle of the invention and including such departures from the present disclosure as come within known or customary practice in the art to which the invention pertains, and as may be applied to the essential features hereinbefore set forth, as fall within the scope of the invention or the limits of the appended claims.

We claim:

1. A sample-containing envelope assembly, comprising:

(a) a closed envelope, (b) a relatively flat sample protector of thin pliable plastic material and of generally rectangular shape disposed within the envelope, (c) the sample protector of thin pliable plastic material having a relatively deep sample-holding pocket of a pre-selected shape, (d) a relatively flat and fragile sample disposed within the sample-holding pocket, (e) the sample having approximately the same thickness as the depth of the sample-holding pocket, and (f) the sample-holding pocket has a flat floor and its periphery is formed by a raised portion of the pliable sheet material which provides the required thickness to protect the sample.

2. The sample-containing envelope assembly as set forth in claim 1, wherein:

(a) the sample protector has a plurality of raised elements which in aggregate comprise the raised portion.

3. The sample-containing envelope assembly as set forth in claim 2, wherein:

(a) the plurality of raised elements are formed from the pliable sheet material and extend over the entire area of the protector with the exception of the sample-holding pocket.

4. The sample-containing envelope assembly as set forth in claim 1, wherein:

(a) the envelope has means for quickly opening the envelope and removing the sample.

5. The sample-containing envelope assembly as set forth in claim 1, wherein:

(a) the envelope is pre-printed and contains advertising concerning the enclosed sample.

6. The sample-containing envelope as set forth in claim 1, wherein:

(a) the envelope has printing which shows the manner of opening the envelope.

7. A sample-containing envelope assembly, comprising:

(a) a closed envelope which consists of two preprinted opposed paper panels held together by glue strips adjacent the outer peripheral edges (b) a relatively thick and flat sample protector having a large surface area which is disposed within the envelope (c) the sample protector having a sample holding pocket with a depth approximately the same thickness as the sample protector (d) the sample protector having a substantial flat area beside the pocket which is approximately the area of the pocket (e) a relatively flat and fragile sample disposed within the sample holding pocket and having approximately the same thickness as the depth of the pocket (f) the sample protector having substantially the same shape as that of the envelope and having a small internal clearance from the peripheral sections thereof, (g) the sample protector being made of thin pliable plastic material formed to give a relatively thick cross section, (h) the sample holding pocket having a flat floor with its periphery formed by a raised portion of the pliable sheet material which provides the required thickness to protect the sample, and (i) a tear strip disposed adjacent one edge of the envelope and adjacent the sample protector such that on removal of the tear strip portion of the envelope the envelope is opened and the sample protector can be readily removed.

* * * * *